US012527448B2

(12) United States Patent
Zhang

(10) Patent No.: US 12,527,448 B2
(45) Date of Patent: Jan. 20, 2026

(54) HAND-HELD VACUUM CLEANER

(71) Applicant: Shenzhen Fanttik Technology Innovation Co., Ltd., Shenzhen (CN)

(72) Inventor: Yunpiao Zhang, Shenzhen (CN)

(73) Assignee: Shenzhen Fanttik Technology Innovation Co., Ltd., Shenzhen (CN)

( * ) Notice: Subject to any disclaimer, the term of this patent is extended or adjusted under 35 U.S.C. 154(b) by 469 days.

(21) Appl. No.: 18/201,101

(22) Filed: May 23, 2023

(65) Prior Publication Data

US 2024/0389807 A1 Nov. 28, 2024

(51) Int. Cl.

| | |
|---|---|
| ***A47L 9/02*** | (2006.01) |
| ***A47L 5/24*** | (2006.01) |
| ***A47L 9/14*** | (2006.01) |
| ***A47L 9/24*** | (2006.01) |
| ***A47L 9/32*** | (2006.01) |

(52) U.S. Cl.

CPC ..... *A47L 9/02* (2013.01); *A47L 5/24* (2013.01); *A47L 9/1409* (2013.01); *A47L 9/244* (2013.01); *A47L 9/248* (2013.01); *A47L 9/322* (2013.01)

(58) Field of Classification Search

CPC . A47L 9/02; A47L 5/24; A47L 9/1409; A47L 9/244; A47L 9/248; A47L 9/322

See application file for complete search history.

(56) References Cited

U.S. PATENT DOCUMENTS

| | | | | |
|---|---|---|---|---|
| 7,870,640 | B2 * | 1/2011 | Hinklin | A47L 5/14 15/330 |
| 7,958,597 | B2 * | 6/2011 | Frantzen | A47L 9/009 15/328 |
| 12,390,067 | B2 * | 8/2025 | Conrad | A47L 5/24 |

FOREIGN PATENT DOCUMENTS

| | | | | |
|---|---|---|---|---|
| CN | 111425416 A | * | 7/2020 | H02K 7/14 |

OTHER PUBLICATIONS

Black and Decker Pivot Vac Instruction Manual (Year: 2007).*

* cited by examiner

*Primary Examiner* — Ryan J. Walters

(57) ABSTRACT

A hand-held vacuum cleaner includes a main body including a casing and a motor fan assembly arranged in the casing. A dirt container is rotatably connected to the main body and has a hollow barrel communicating with the casing. A nozzle has a first end fixed to the barrel and a second opposite end defining an air inlet communicating with the barrel to allow air to be sucked into the air inlet. A connection assembly includes a first connection member, a second connection member and multiple rolling members. The first connection member is fixed to the main body and has a first surface. The second connection member is connected to one end of the barrel and rotatably connected to the first connection member. The second connection member has a second surface facing the first surface. The first surface defines a circular groove, and the second surface defines multiple receiving holes.

10 Claims, 14 Drawing Sheets

HAND-HELD VACUUM CLEANER

TECHNICAL FIELD

The present disclosure generally relates to vacuum cleaners, and particularly to a hand-held vacuum having a pivotable nozzle.

BACKGROUND

Broadly speaking, there are four types of vacuum cleaner: "upright" vacuum cleaners, "cylinder" cleaners (also referred to as "canister" cleaners), "handheld" vacuum cleaners and "stick" vacuum cleaners, the latter being popularly referred to as "stick-vac" cleaners, or simply "stick-vacs".

Handheld vacuum cleaners are relatively small, highly portable vacuum cleaners, best suited to relatively low duty applications such as spot cleaning floors and upholstery in the home, interior cleaning of cars and boats etc. Unlike upright cleaners and cylinder cleaners, they are designed to be carried in the hand during use, and tend to be battery-operated.

It is known to provide a handheld vacuum cleaner with a moveable nozzle. For example, some vacuum cleaners have nozzles that are pivotable between different positions. This makes reaching high surfaces or accessing low surfaces easier.

Although these vacuum cleaners with rotating nozzles can meet basic needs, it is useful and desirable to provide a new vacuum cleaner with a pivotable nozzle.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
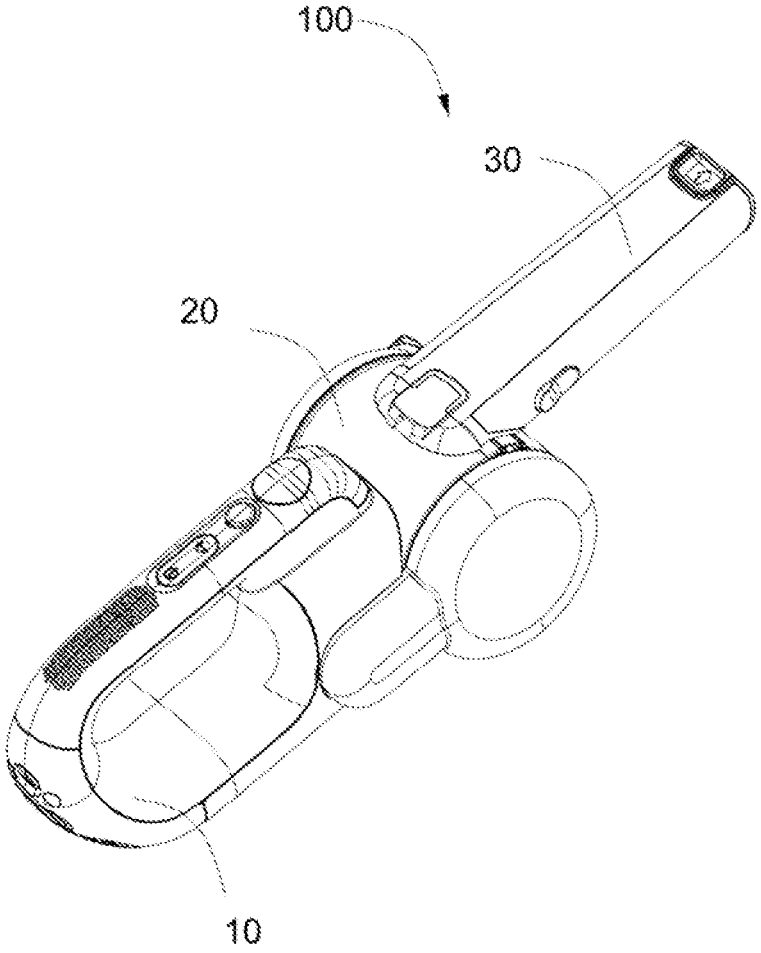
FIG. 1 is a schematic isometric view of a hand-held vacuum cleaner according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

The present disclosure provides a hand-held vacuum cleaner with a pivotable nozzle. The vacuum cleaner has a main body and a dirt container which are rotatably connected to each other. The nozzle is fixed on the lateral surface of the dirt container. When in use, a user can apply pushing or pulling force to the nozzle as required, so that the nozzle and the dirt container rotate relative to the main body as a whole until they reach a desired position. The nozzle is a hollow structure, which provides an air inlet and a first air intake channel required for the vacuum cleaner to operate, through which air can enter the dirt container. A connection assembly that rotatably connects the main body to the dirt container is provided with a second air intake channel. The air entering the dirt container can enter the main body through the second air intake channel after being filtered by a filter assembly, and finally flow out through air outlet vents on the main body.

The connection assembly is fixed to the main body and detachably connected to the dirt container. When needed, a user can detach the dirt container from the connection assembly, thereby exposing an open end of the dirt container, so that the user can remove the filter assembly from the dirt container. The connection assembly may include a first connection member and a second connection member which are rotatably connected to each other, so as to provide the required rotational motion of the dirt container relative to the main body. A number of rolling elements (such as balls) are arranged between the opposing surfaces of the first connection member and the second connection member. When the first connection member and the second connection member rotate relative to each other, the rolling elements roll between the first connection member and the second connection member. By arranging the rotatable rolling elements between the first connection member and the second connection member, it is beneficial to reduce friction and improve the smoothness of relative rotation between the first connection member and the second connection member.

The nozzle may include an integrally formed fixed nozzle and a sliding nozzle slidably accommodated in the fixed nozzle, which provides a retractable nozzle structure. When needed, a user can draw out a portion of the sliding nozzle, so that the nozzle becomes longer.

Figure 2:
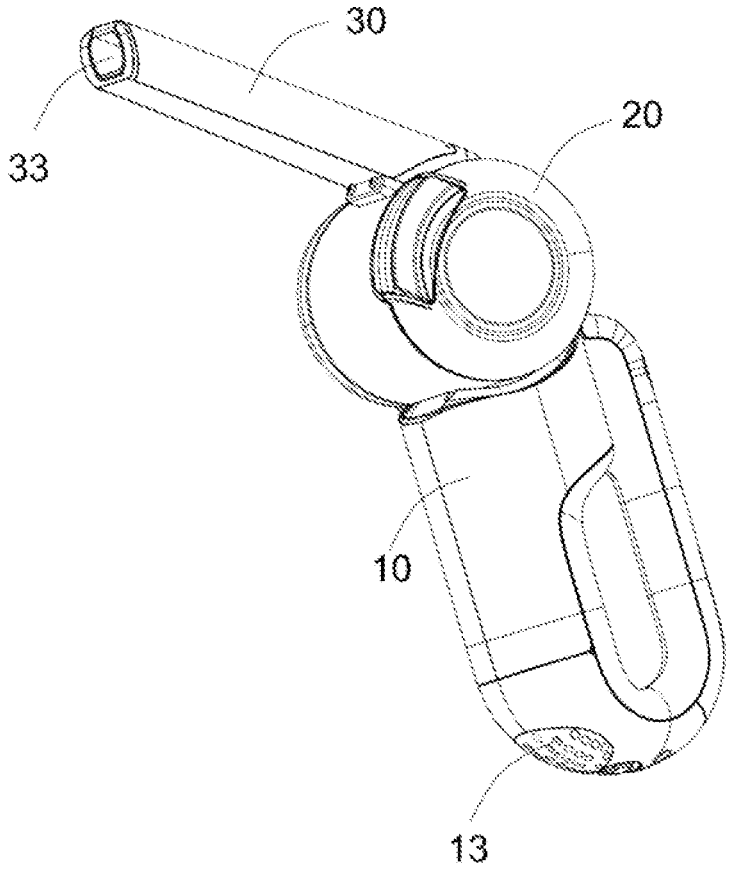
FIG. 2 is a schematic isometric view of the hand-held vacuum cleaner viewed from a different perspective, with the nozzle rotated from the position shown in FIG. 1.
Figure 3:
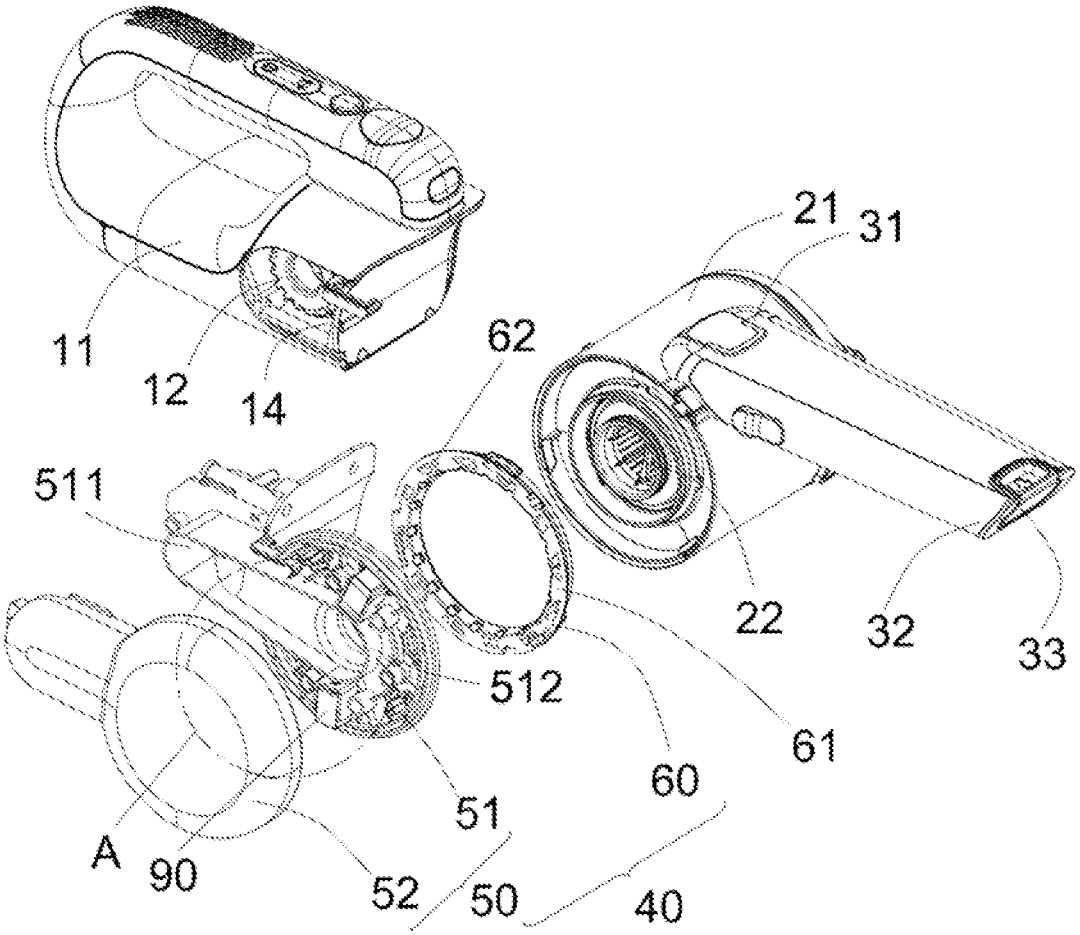
FIG. 3 is an exploded view of the hand-held vacuum cleaner according to one embodiment.

Referring to FIGS. 1-3, in one embodiment, a hand-held vacuum cleaner 100 may include a main body 10, a dirt container 20, a nozzle 30, and a connection assembly 40. The main body 10 may include a casing 11 and a motor fan assembly 12 arranged in the casing 11. The casing 11 defines a number of air outlet vents 13. The dirt container 20 is rotatably connected to the main body 10 and includes a hollow barrel 21 and a filter assembly 22 arranged in the barrel 21. The barrel 21 communicates with the casing 11. The nozzle 30 has a first end 31 fixed to the barrel 21 and a second end 32 opposite to the first end 31. An air inlet 33 is defined in the second end 32 and communicates with the barrel 21 to allow air to be sucked into the air inlet 33, flow through the filter assembly 22 and flow out of the casing 11 through the air outlet vents 13 when the motor fan assembly 40 is in operation.

Figure 4:
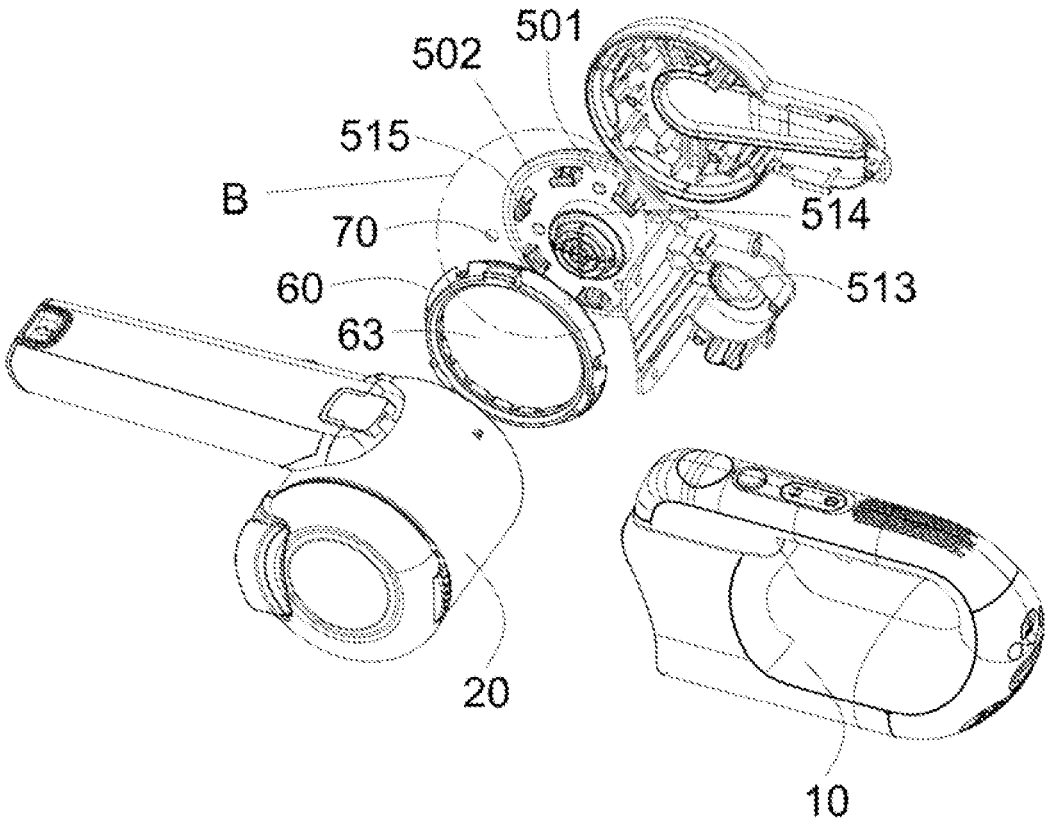
FIG. 4 is an exploded view of the hand-held vacuum cleaner viewed from a different perspective.

Referring to FIGS. 3 and 4, in one embodiment, the connection assembly 40 may include a first connection member 50, a second connection member 60 and a number of rolling members 70. The first connection member 50 is fixed to the main body 10 and has a first surface 501. The second connection member 60 is connected to one end of the barrel 21 and rotatably connected to the first connection member 50. The second connection member 60 has a second surface 61 facing the first surface 501. One of the first surface 501 and the second surface 61 defines a circular groove (e.g., groove 502 described below), and the other of the first surface 501 and the second surface 61 defines a number of receiving holes (e.g., holes 62 described below). The rolling members 70 are arranged between the first surface 501 and the second surface 61, accommodated in the receiving holes, and accommodated in the circular groove. Relative rotation of the first connection member 501 relative to the second connection member 61 causes the rolling members 70 to roll in the receiving holes and along the circular groove.

In one embodiment, the circular groove is defined in the first surface 501 of the first connection member 50, and is referred to as the circular groove 502 hereinafter, which is clearly shown in an enlarged view in FIG. 12. The receiving holes are defined in the second surface 61 of the second connection member 60, and are referred to as the receiving holes 62 hereinafter. In one embodiment, the rolling members 70 are spherical, and the circular groove 502 and the receiving holes 62 are sized and shaped corresponding to the rolling members 70 so that the rolling member 70 can freely roll in the circular groove 502 and the receiving holes 62. It should be noted that the structure of the rolling members 70 are not limited to a sphere, and other suitable shapes can be selected according to actual needs, which will not be described here.

By providing rolling members 70 that can roll between the first surface 501 of the first connection member 50 and the second surface 61 of the second connection member 60, a small gap is formed between the first surface 501 and the second surface 61 due to the existence of the rolling element 70, and the first surface 501 and the second surface 61 are not in contact with each other. When the first connection member 50 rotates relative to the second connection member 60, there is no friction between the first surface 501 and the second surface 61. That is, the above-mentioned configuration is beneficial to reduce friction and improve smoothness of relative rotation between the first connection member 50 and the second connection member 60.

Referring to FIG. 3, in one embodiment, the casing 11 is provided with a receiving chamber 14 at one end (hereinafter referred to as "front end") adjacent to the dirt container 20, and the motor fan assembly 12 is accommodated in the receiving chamber 14. The motor fan assembly 12 can be arranged horizontally, that is, the motor fan assembly 12 can be arranged along a direction perpendicular to the lengthwise direction of the casing 11. The motor fan assembly 12 includes a motor and a fan mounted on the output shaft of the motor, and the fan can rotate coaxially with the output shaft of the motor. After the motor shaft drives the fan to rotate, the air with dirt (such as dust and debris) is sucked into the nozzle 30 through the air inlet 33.

Figure 5:
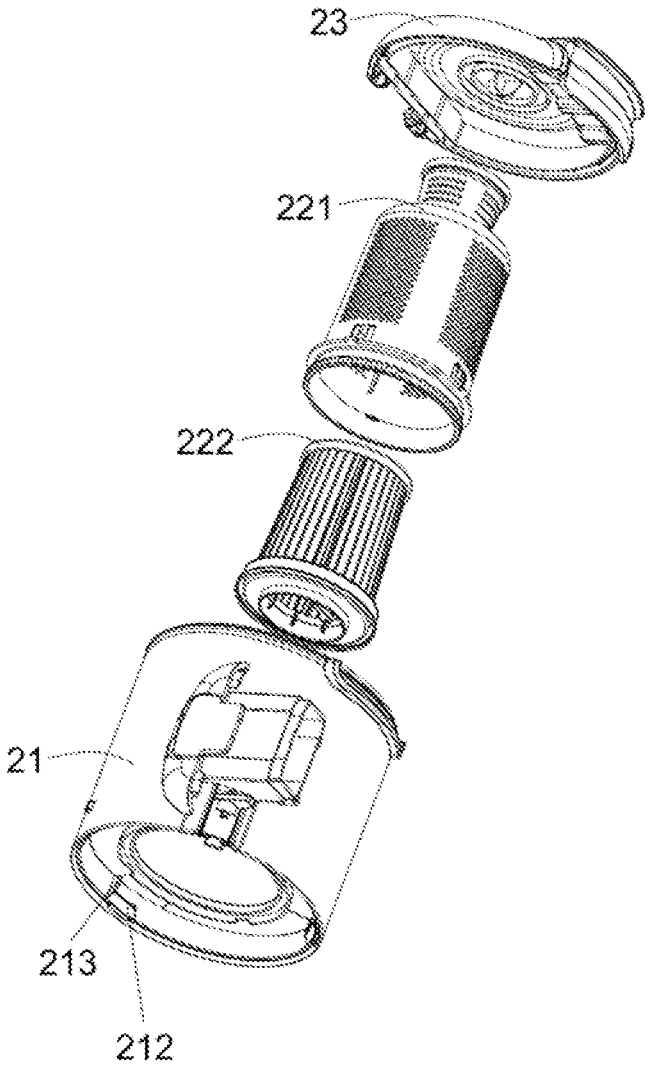
FIG. 5 is an exploded view of the dirt container of the hand-held vacuum cleaner.

Referring to FIGS. 1 and 5, in one embodiment, the barrel 21 is roughly a hollow cylinder with two ends open, which is arranged perpendicularly relative to the main body 10. Specifically, the central axis of the barrel 21 is perpendicular to the lengthwise direction of the casing 11, which means that the central axis of the barrel 21 is substantially parallel to the axis of rotation about which the motor shaft of the motor fan assembly 12 rotates. The barrel 21 is adjacent to the front end of the main body 10. In one embodiment, the front end surface of the main body 10 is a concave surface matching the lateral surface of the barrel 21, and is spaced a small distance from the lateral surface of the barrel 21, thereby allowing relative rotation between the main body 10 and the barrel 21.

In one embodiment, the dirt container 20 further includes a pivotable cover 23 rotatably connected to the first end of the barrel 21 (i.e., the top end in FIG. 5). The pivotable cover 23 can be in the closed state shown in FIG. 2, and a user can open the pivotable cover 23 to put the filter assembly 22 into the barrel 21 from the first end when needed. In one embodiment, the filter assembly 22 includes a first filter component 221 and a second filter component 222. The first filter component 221 is a coarse filter component, which is used to filter relatively large-sized objects (such as paper debris) in the airflow. The first filter component 221 is a hollow, thin-walled solid of revolution with an open end, and a number of through holes for filtering purposes are defined in the lateral surface of the first filter component 221. The second filter component 222 is a fine filter component, which can filter out extremely tiny particles. The second filter component 222 is a hollow solid of revolution, which can be placed into the first filter component 221 from the opening end of the first filter component 221.

The airflow with dirt entering the barrel 21 from the nozzle 30 first enters the space between the lateral inner surface of the barrel 21 and the lateral outer surface of the first filter component 221. The airflow first passes through the through holes on the lateral outer surface of the first filter component 221 along the radial direction. During this process, objects of relatively large size (such as paper debris) cannot pass through the above-mentioned through holes and are filtered out. The airflow filtered by the first filter component 221 enters the space between the lateral inner surface of the first filter component 221 and the second filter component 222, and the airflow continues to pass through the second filter component 222 along the radial direction. During this process, the second filter component 222 can filter out extremely tiny particles in the airflow. The clean air filtered by the second filter component 222 flows toward the main body 10 along the axial direction of the second filter component 222.

It can be understood that the structure of the filter component 22 is not limited to the foregoing description, and it can adopt other suitable structures in the prior art as required, which will not be described here.

Figure 6:
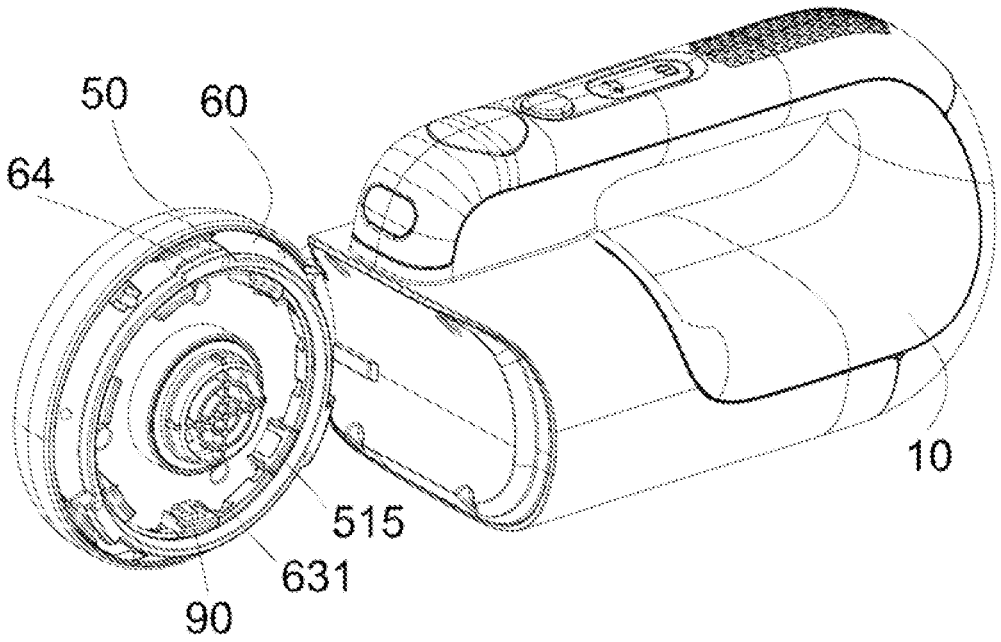
FIG. 6 is an isometric view of an assembly formed by a main body and a connecting assembly of the hand-held vacuum cleaner that are connected to each other.

Referring to FIG. 6, in one embodiment, the connection assembly 40 is fixed to the main body 10, and the second connection member 60 is detachably connected to the second end (i.e., the bottom end in FIG. 5) of the barrel 21 opposite to the pivotable cover 23. When needed, a user can remove the barrel 21 from the assembly (i.e., the assembly composed of the connection assembly 40 fixed to the main body 10) shown in FIG. 6. The second end of the barrel 21 is thus exposed, and the user can take out the filter assembly 22 from the second end of the barrel 21. In this way, it is convenient for the user to clean the first filter component 221 and the second filter component 222.

Referring to FIGS. 3 and 4, in one embodiment, the first connection member 50 includes a body 51 and a cover 52. A portion of the body 51 is accommodated in the receiving chamber 14 of the casing 11, and a wall 512 protrudes from a side surface of the body 51 facing the cover 52. The wall 512 forms a channel 511. The side surface of the body 51 facing the cover 52 is also provided with through holes 513 and 514 for communicating the channel 511 with the interior of the casing 11 and the interior of the barrel 21. The clean air filtered by the second filter component 222 flows out of the barrel 21 along the axial direction of the second filter component 222, flows into the channel 511 through the through hole 513, and then flows into the casing 11 through the through hole 514, and finally flows out to the outside of the casing 11 through the air outlet vents 13 on the casing 11. The cover 52 is fixed on the casing 11 and the body 51, and the cover 52 covers the channel 511 to prevent the clean air flowing into the channel 511 from leaking.

Referring to FIGS. 4 and 6, in one embodiment, the second connection member 60 defines a central through hole 63, and a number of hooks 515 protrude from the first surface 501 of the first connection member 501. Ends of the hooks 63 pass through the central through hole 63 and hook an edge of the central through hole 63 to prevent the second connection member 60 from disengaging from the first connection member 50.

In one embodiment, the first surface 501 is a side surface of the body 51 opposite to the wall 512. Referring to FIG. 12, a number of hooks 515 are arranged along an imaginary circle. Each hook 515 includes a protruding portion 516 protruding from the first surface 501, and a book portion 517 extending from the end of the protruding portion 516 along the radial direction of the imaginary circle and away from the center of the imaginary circle. In the process of connecting the main body 51 to the second connection member 60, a user can first align the main body 51 and the second connection member 60, and then push the second connection member 60 so that the hook portions 517 slide against the inner surface of the central through hole 63. During this process, the protruding portions 516 undergo slight elastic deformation until the hook portions 517 move to a desired position. In this case, the hook portions 517 rebounds, so that the book portions 517 book the edge of the central through hole 63. The body 51 and the second connection member 60 are thus rotatably connected to each other. The hook portions 517 can prevent the second connection member 60 from detaching from the body 51, but does not restrict the relative rotation between the second connection member 60 and the body 51.

Figure 7:
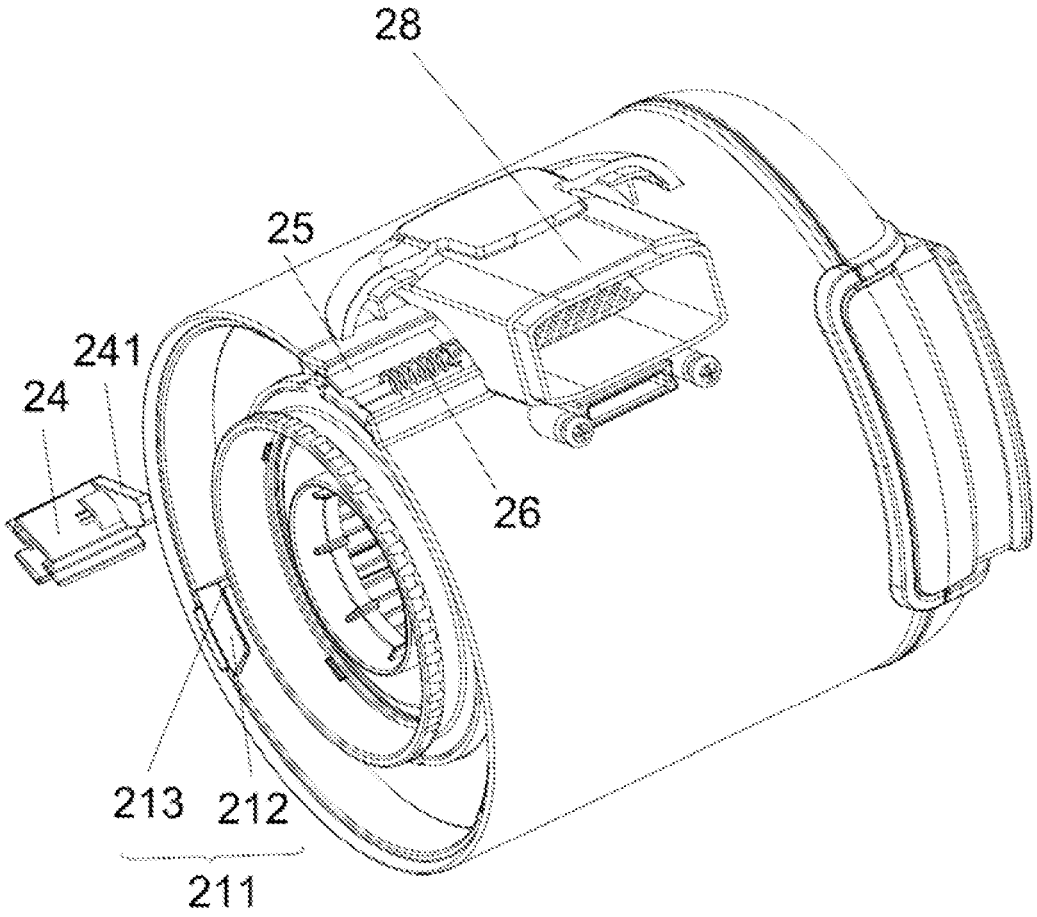
FIG. 7 is a partially exploded view of the dirt container of the hand-held vacuum cleaner.
Figure 8:
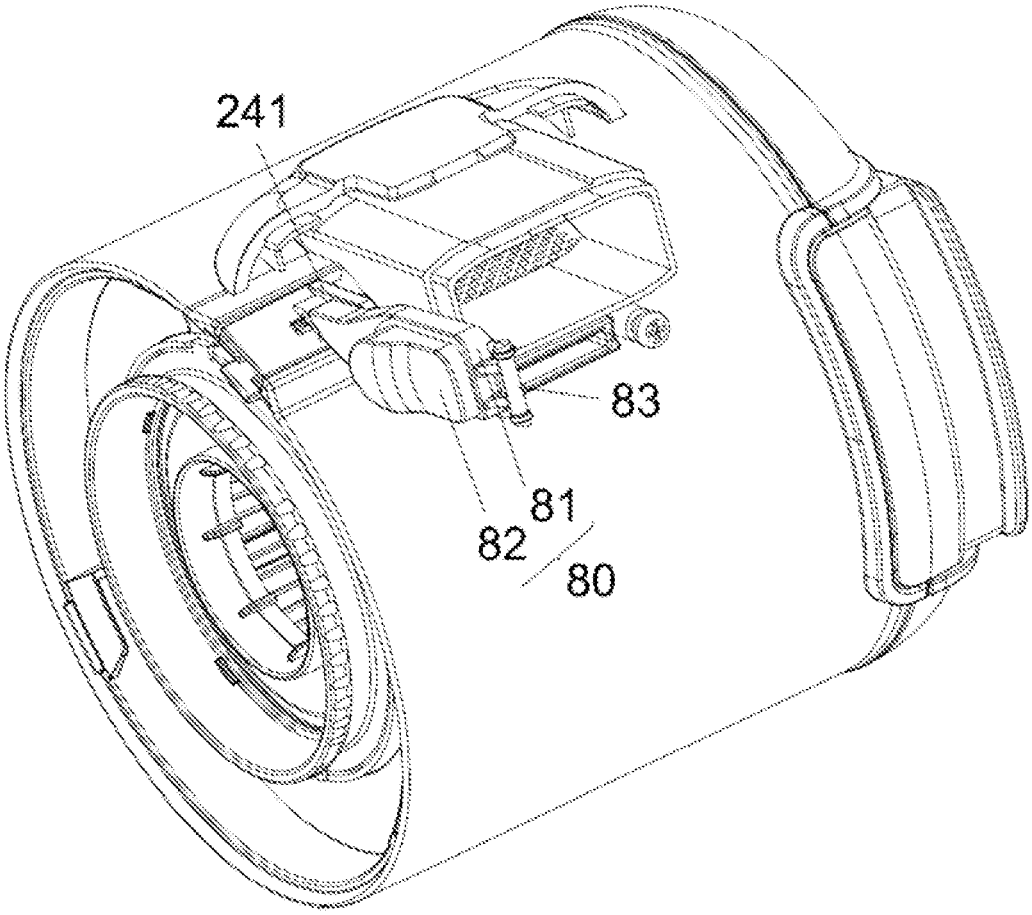
FIG. 8 is an isometric view of the dirt container of the hand-held vacuum cleaner.
Figure 12:
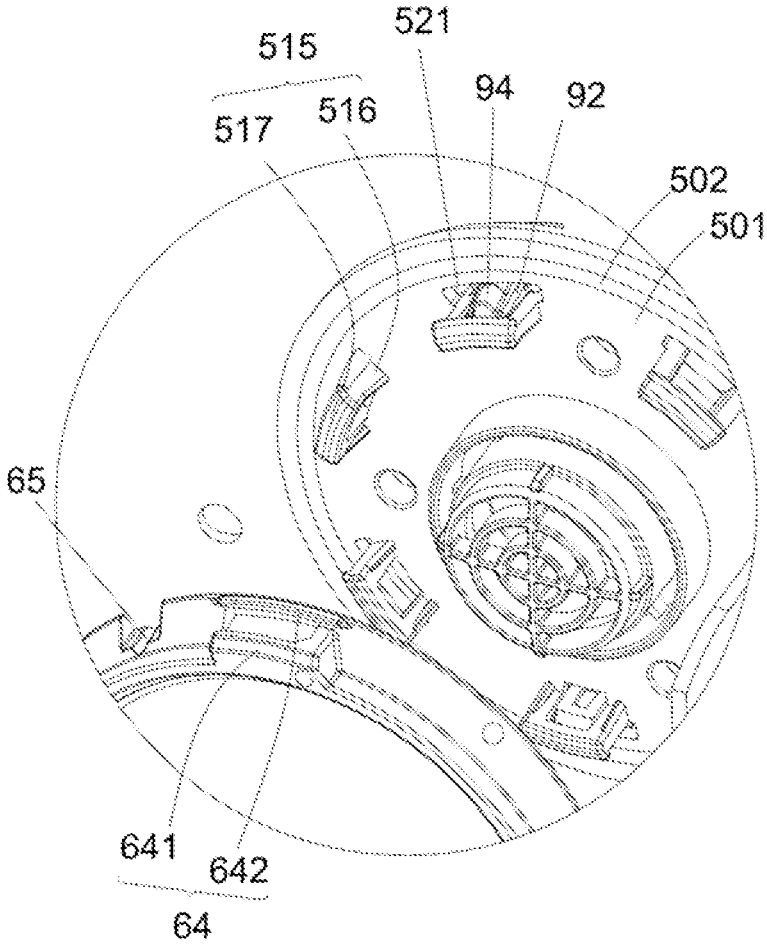
FIG. 12 is an enlarged view of a portion B of FIG. 4.

Referring to FIGS. 6 and 12, in one embodiment, a number of engaging members 64 protrude from a peripheral surface of the second connection member 60, and an inner surface of the barrel 21 includes a number of counterpart members 211 (see FIG. 7). The engaging members 64 are respectively engaged with the counterpart members 211, which prevents axial relative movement between the second connection member 60 and the barrel 21. Specifically, each engaging member 64 includes a first protrusion 641 extending along the circumferential direction of the second connection member 60 and a second protrusion 642 opposite to the first protrusion 641. Each counterpart member 211 includes a third protrusion 212 extending in the circumferential direction of the barrel 21 and a fourth protrusion 213 extending in the axial direction of the barrel 21, which are clearly shown in FIG. 5. The third protrusion 213 is received between the first protrusion 641 and the second protrusion 642, thereby preventing the relative axial movement of the second connection member 60 relative to the barrel 21. When a user connects the second connection member 60 to the barrel 21, he/she can first place the second connection member 60 into the opening at the second end of the barrel 21, and then rotate the second connection member 60. When the end of the first protrusion 641 comes into contact with the fourth protrusion 213, the second connection member 60 cannot continue to rotate relative to the barrel 21, signaling the user that the third protrusion 213 has moved to a desired position between the first protrusion 641 and the second protrusion 642. In one embodiment, three engaging members 64 protrude from the peripheral surface of the second connection member 60, and correspondingly, three counterpart members 211 are provided on the inner surface of the barrel 21. It can be understood that the number of the engaging members 64 and the counterpart members 211 is not limited to the foregoing description, and can be adjusted according to actual needs.

Referring to FIGS. 7 and 12, in one embodiment, the peripheral surface of the second connection member 60 defines a recess 65, and the dirt container 20 further includes a locking member 24 that is slidably connected to the barrel 21. An end of the locking member 24 is received in the recess 65, which prevents relative rotation between the second connection member 60 and the barrel 21. In one embodiment, a sliding groove 25 is defined in the lateral surface of the barrel 21, and the locking member 24 is slidably received in the sliding groove 25. An elastic member 26 (e.g., a coil spring) can be arranged in the sliding groove 25, and one end of the elastic member is in contact with one end of the locking member 24 to apply a pushing force to the locking member 24, so that the opposite end of the elastic member remains contained in the recess 65. In one embodiment, the vacuum cleaner may further include a button (described in detail below) to push the locking member 24. After the button is pressed by a user, the locking member 24 is pushed by the button and slides in a direction away from the second connection member 60, thereby allowing the end of the locking member 24 to leave the recess 65. The dirt container 20 together with the nozzle 30 can then be detached from the assembly shown in FIG. 6. During the process of connecting the second connection member 60 and the barrel 21, when the end of the first protrusion 641 comes into contact with the fourth protrusion 213, the second connection member 60 cannot continue to rotate relative to the barrel 21, signaling the user that the third protrusion 213 has moved to a desired position between the first protrusion 641 and the second protrusion 642. Then, the user can release the button, so that the end of the locking member 24 is allowed to move into the recess 65, so as to connect the second connection member 60 and the barrel 21 together.

Referring to FIGS. 7-10, in one embodiment, the cleaner further includes a button 80 that is rotatably connected to the nozzle 30. The button 80 is to receive pressing from a user to rotate relative to the nozzle 30 to push the locking member 24 to slide away from the second connection member 60 so as to cause the end of the locking member 24 to move out of the recess 65. In one embodiment, the button 80 includes a base 81 and a pressing portion 82 protruding from the base 81. The base 81 is located in the nozzle 30.

The pressing portion 82 is received in a button bole on the nozzle 30 and is partially external to the nozzle 30. A rotating shaft 83 is arranged on the first end of the base 81 away from the locking member 24, and opposite ends of the rotating shaft 83 are received in shaft holes in the nozzle 30, so that the button 80 is rotatably connected to the nozzle 30. A protruding wall 241 is formed on the end of the locking member 24 facing away from the recess 65, and a second end of the base 81 opposite to the aforementioned first end is in contact with the protruding wall 241. When the pressing portion 82 is pressed by a user, the base 81 rotates relative to the nozzle 30, so that the second end of the base 81 exerts a pushing force on the protruding wall 241, causing the end of the locking member 24 to move out of the recess 65. After the user releases the pressing portion 82, the elastic member 26 pushes the locking member 24 to slide toward the second connection member 60 until the end thereof is received in the recess 65.

Figure 11:
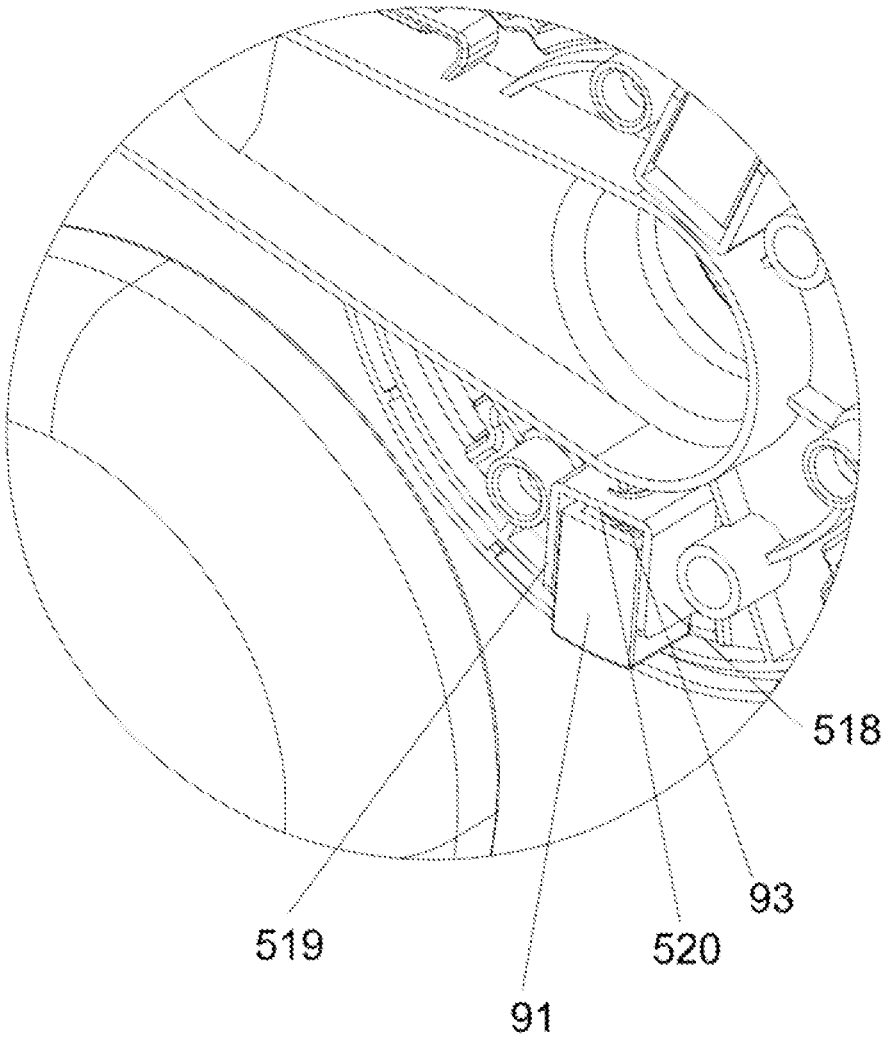
FIG. 11 is an enlarged view of a portion A of FIG. 3.

Referring to FIGS. 3, 11 and 12, in one embodiment, a spring-loaded positioning member 90 protrudes from the first surface 501 of the first connection member 50. The positioning member 90 is movable along a radial direction of the first connection member 50. The second connection member 60 defines a central through hole 63, and an inner surface of the central through hole 63 defines a number of grooves 631. The second connection member 60 is locked to the first connection member 50 when the positioning member 90 is partially received in one of the grooves 631. With such configuration, a user can push the nozzle 30 so that the nozzle 30 rotates together with the dirt container 20 to a desired position, and the nozzle 30 and the dirt container 20 are kept at the desired position through the engagement of the positioning member 90 with one of the grooves 631.

Referring to FIGS. 11 and 12, in one embodiment, the side surface of the body 51 facing the cover 52 is provided with three walls 518, 519, 520 connected to one another. The walls 518 and 519 are spaced apart from and parallel to each other, and the wall 520 is located between and connected to the two walls 518 and 519, forming a receiving space with one end open. The positioning member 90 includes a substantially cuboid body 91 and a positioning protrusion 92 protruding from the top of the body 91. The body 91 is slidably accommodated in the receiving space, and a compressed spring 93 is arranged between the main body 91 and the wall 520. The body 51 defines a through hole 521 through which the positioning protrusion 92 passes. The positioning protrusion 92 includes a half cylinder 94 facing the lateral inner side of the central through hole 63 of the second connection member 60. When the half cylinder 94 is received in one of the grooves 631, the second connection member 60 is locked to the first connection member 50. When needed, a user can push the nozzle 30 so that the nozzle 30 rotates together with the dirt container 20. During the rotation, the half cylinder 94 is first moved out of a groove 631, and then moves on the lateral inner surface of the central through hole 63 until moving into another groove 631. If the nozzle 30 and the dirt container 20 continue to rotate, the half cylinder 94 will repeat the above process until the nozzle 30 and the dirt container 20 stop rotating. Finally, the half cylinder 94 will be received in one of the grooves 631, and the body 91 will be held in the groove 631 when not subjected to external force because the body 91 is pushed by the spring 93.

Figure 9:
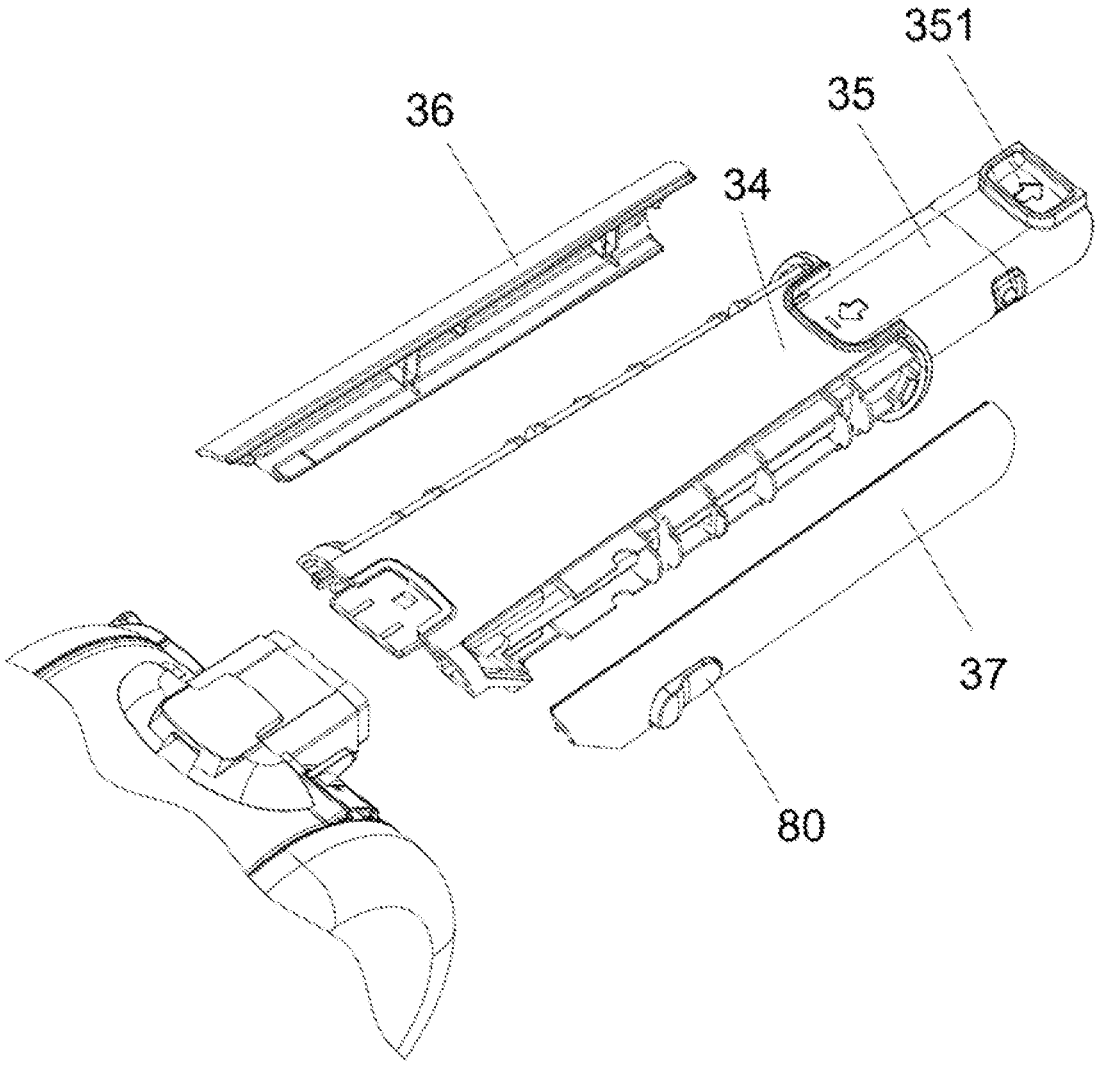
FIG. 9 is an exploded view of the nozzle of the hand-held vacuum cleaner.
Figure 10:
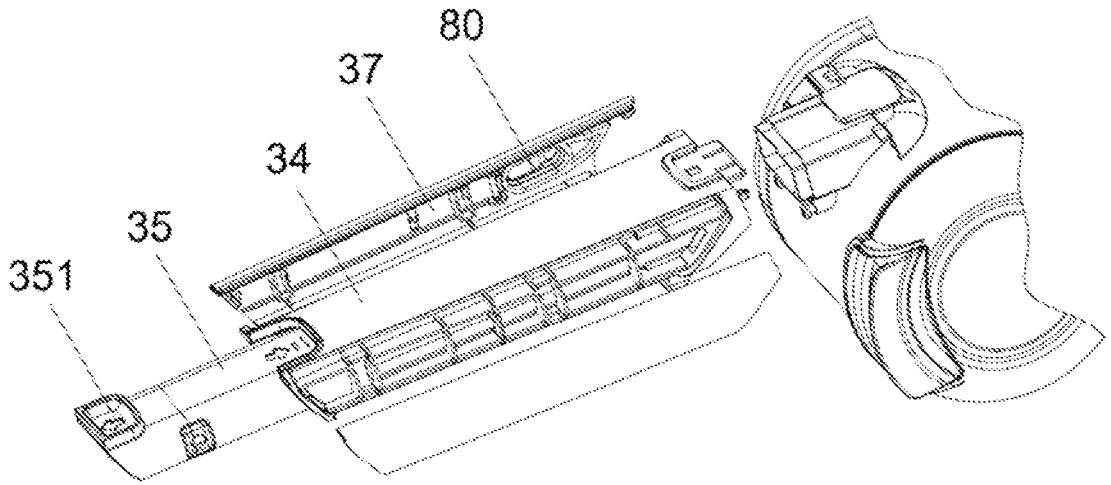
FIG. 10 is an exploded view of the nozzle of the hand-held vacuum cleaner viewed from a different perspective.

Referring to FIGS. 9 and 10, in one embodiment, the nozzle 30 includes an integrally formed fixed nozzle 34 and a sliding nozzle 35 slidably accommodated in the fixed nozzle 34, and one end of the fixed nozzle 34 is fixed to the barrel 21. In one embodiment, the nozzle 30 further includes side covers 36 and 37 connected to opposite sides of the fixed nozzle 34. The button 80 is rotatably connected to the side cover 37. The sliding nozzle 35 is partly accommodated in the fixed nozzle 34. The opening end of the sliding nozzle 35 is the air inlet 33, and the top of the sliding nozzle 35 is provided with a recessed portion 351 adjacent to the air inlet 33. When needed, a user can put a finger (such as the index finger) into the air inlet 33, and put another finger (such as the thumb) into the recess 351, and then the user can apply a pushing or pulling force to the sliding nozzle 35, so as to pull the sliding nozzle 35 to a desired position (e.g., the position shown in FIG. 10), or push the sliding nozzle 35 back to its original position (i.e., the position shown in FIG. 1).

Figure 13:
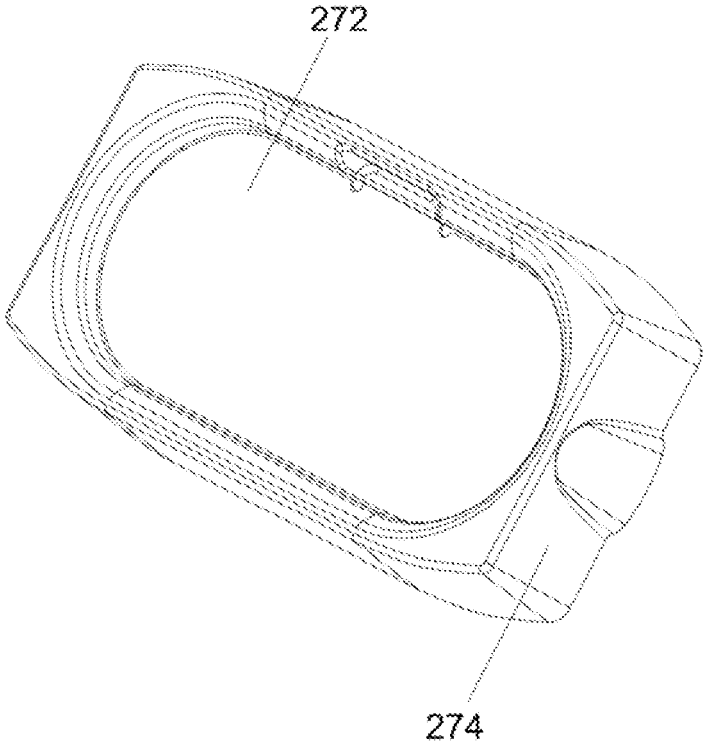
FIG. 13 is an isometric view of a cover plate of the hand-held vacuum cleaner according to one embodiment.
Figure 14:
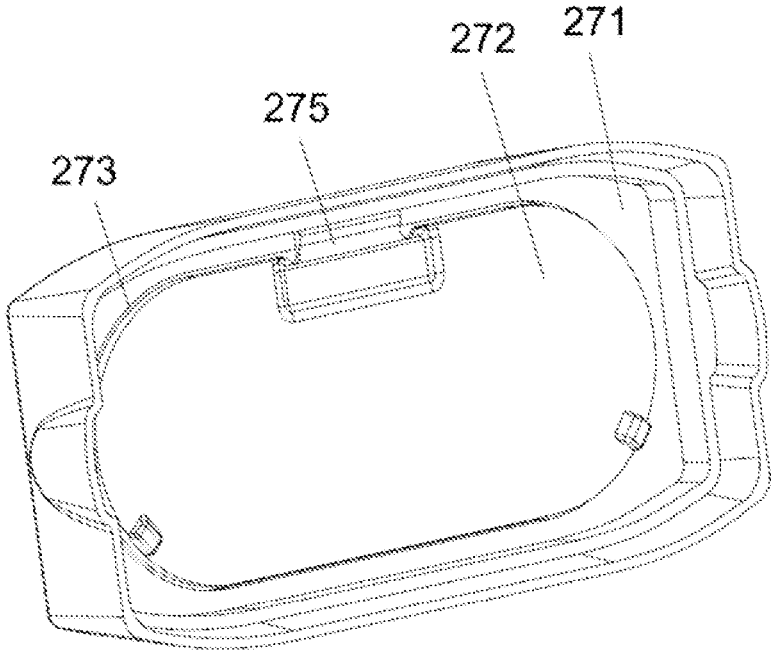
FIG. 14 is another isometric view of a cover plate viewed from a different perspective.

Referring to FIGS. 7, 13 and 14, in one embodiment, the cleaner further includes a cover plate 27. A connection tube 28 protrudes from a peripheral external surface of the barrel 21 and has an open end that faces the first end of the nozzle 30, which is clearly shown in FIG. 9. The cover plate 27 is connected to the connection tube 28 and covers the open end. The cover plate 27 includes a body 271 and a movable plate 272. The body 271 defines a through hole 273, and the movable plate 272 is deflectably connected to the body 271 and received in the through hole 273. The movable plate 272 is deflectable relative to the body 271 when pushed by the air sucked into the air inlet 33, thereby allowing the air to flow into the barrel 21 through the connection tube 28.

In one embodiment, the body 271 and the movable plate 272 are integrally formed together, which can be made of elastic material (such as rubber). The main body 271 is substantially square, and walls 274 protrude from four edges thereof, so that the cover plate 27 can be arranged around the open end of the connection tube 28. The movable plate 272 has approximately the same shape as the through hole 273, and the size of the movable plate 272 is slightly smaller than the size of the through hole 273. One edge of the movable plate 272 is deflectably connected to the inner surface of the body 271 through a connecting portion 275. When the movable plate 272 is pushed by the air, the connecting portion 275 is elastically deformed, thereby allowing the movable plate 272 to deflect and allowing the air to flow into the barrel 21. After the motor fan assembly stops working, the movable plate 272 is no longer pushed by the air, and the connecting portion 275 rebounds so that the movable plate 272 rotates to its initial position. Then, the movable plate 272 basically covers the open end of the connection tube 28 and can prevent objects from entering the barrel 21.

After understanding the foregoing content of the present disclosure, those skilled in the art will realize that the motor of the present disclosure does not necessarily need to be arranged in the main body. Based on the above-mentioned spirit, the present disclosure further provides a hand-held vacuum cleaner that includes the main body 10, the dirt container 20, the nozzle 30, and the connection assembly 40. The main body 10 includes a casing 11 that defines a number of air outlet vents 13. The dirt container 20 is rotatably connected to the main body 10 and includes a hollow barrel 21 and a filter assembly 22 arranged in the barrel 21. The barrel 21 communicates with the casing 11. The nozzle 30 has a first end 31 fixed to the barrel 21 and a second end 32 opposite to the first end 31. An air inlet 33 is defined in the second end 32. The nozzle 30 communicates with the barrel 21 to allow air to be sucked into the air inlet 33, flow through the filter assembly 22 and flow out of the casing 11 through the air outlet vents 13. The connection assembly 40 includes a first connection member 50, a second connection member 60 and a number of rolling members 70. The first connection member 50 is fixed to the main body 10 and includes a first surface 501. The second connection member 60 is connected to one end of the barrel 21 and rotatably connected to the first connection member 50. The second connection member 60 includes a second surface 61 facing the first surface 501. One of the first surface 501 and the second surface 61 define a number of receiving holes. The rolling members 70 are arranged between the first surface 501 and the second surface 61. The rolling members 70 are partially accommodated in the receiving holes. Relative rotation of the first connection member 50 relative to the second connection member 60 causes the rolling members 70 to roll in the receiving holes.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A hand-held vacuum cleaner comprising:

a main body comprising a casing and a motor fan assembly arranged in the casing, the casing defining a plurality of air outlet vents;

a dirt container rotatably connected to the main body and comprising a hollow barrel and a filter assembly arranged in the barrel, the barrel communicating with the casing;

a nozzle having a first end fixed to the barrel and a second end opposite to the first end, an air inlet defined in the second end and communicating with the barrel to allow air to be sucked into the air inlet, flow through the filter assembly and flow out of the casing through the air outlet vents when the motor fan assembly is in operation; and a connection assembly comprising a first connection member, a second connection member and a plurality of rolling members, the first connection member fixed to the main body and comprising a first surface, the second connection member connected to one end of the barrel and rotatably connected to the first connection member, the second connection member comprising a second surface facing the first surface, a first of the first surface and the second surface defining a circular groove, and a second of the first surface and the second surface defining a plurality of receiving holes, the rolling members arranged between the first surface and the second surface, accommodated in the receiving holes, and accommodated in the circular groove, wherein relative rotation of the first connection member relative to the second connection member causes the rolling members to roll in the receiving holes and along the circular groove.

2. The hand-held vacuum cleaner of claim 1, wherein the second connection member is detachably connected to the end of the barrel.

3. The hand-held vacuum cleaner of claim 2, wherein a plurality of engaging members protrudes from a peripheral surface of the second connection member, and an inner surface of the barrel comprises a plurality of counterpart members, the plurality of engaging members are respectively engaged with the plurality of counterpart members, which prevents axial relative movement between the second connection member and the barrel.

4. The hand-held vacuum cleaner of claim 3, wherein each of the engaging members comprises a first protrusion extending along a circumferential direction of the second connection member and a second protrusion opposite to the first protrusion, each of the counterpart members comprises a third protrusion extending in a circumferential direction of the barrel, the third protrusion is sandwiched between the first protrusion and the second protrusion, which prevents axial relative movement between the second connection member and the barrel.

5. The hand-held vacuum cleaner of claim 4, wherein the peripheral surface of the second connection member defines a recess, and the dirt container further comprises a locking member that is slidably connected to the barrel, an end of the locking member is received in the recess, which prevents relative rotation between the second connection member and the barrel.

6. The hand-held vacuum cleaner of claim 5, further comprising a button that is rotatably connected to the nozzle, wherein the button is configured to receive pressing from a user to rotate relative to the nozzle to push the locking member to slide away from the second connection member so as to cause the end of the locking member to move out of the recess.

7. The hand-held vacuum cleaner of claim 1, wherein the second connection member defines a central through hole, and a plurality of hooks protrude from the first surface of the first connection member, ends of the books pass through the central through hole and hook an edge of the central through hole to prevent the second connection member from disengaging from the first connection member.

8. The hand-held vacuum cleaner of claim 1, wherein a spring-loaded positioning member protrudes from the first surface of the first connection member, and the positioning member is movable along a radial direction of the first connection member, the second connection member defines a central through hole, and an inner surface of the central through hole defines a plurality of grooves, the second connection member is locked to the first connection member when the positioning member is partially received in one of the plurality of grooves.

9. The hand-held vacuum cleaner of claim 1, wherein the nozzle comprises an integrally formed fixed nozzle and a sliding nozzle slidably accommodated in the fixed nozzle, and one end of the fixed nozzle is fixed to the barrel.

10. The hand-held vacuum cleaner of claim 9, further comprising a cover plate, wherein a connection tube protrudes from a peripheral external surface of the barrel and comprises an open end that faces the first end of the nozzle, the cover plate is connected to the connection tube and covers the open end, the cover plate comprises a body and a movable plate, the body defines a through hole, the movable plate is deflectably connected to the body and received in the through hole, the movable plate is deflectable relative to the body when pushed by the air sucked into the air inlet, thereby allowing the air to flow into the barrel through the connection tube.

* * * * *